US006398047B1

(12) United States Patent
Ladendorf et al.

(10) Patent No.: US 6,398,047 B1
(45) Date of Patent: Jun. 4, 2002

(54) END SILL ASSEMBLY WITH CENTER PLATE CASTING

(75) Inventors: Jeffery R. Ladendorf, Chicago, IL (US); John F. Oesch, Grand Haven, MI (US)

(73) Assignee: AMSTED Industries Incorporated, Chicago, IL (US)

( * ) Notice: Subject to any disclaimer, the term of this patent is extended or adjusted under 35 U.S.C. 154(b) by 0 days.

(21) Appl. No.: 09/659,504

(22) Filed: Sep. 11, 2000

(51) Int. Cl.[7] ..... B61G 9/12

(52) U.S. Cl. ..... 213/62 R; 105/420; 213/69; 213/57; 213/60; 213/61; 213/62

(58) Field of Search ..... 213/62 R, 66, 213/69, 51, 57, 60, 61, 62, 63; 105/420

(56) References Cited

U.S. PATENT DOCUMENTS 253,838 A * 2/1882 Butler ..... 105/420
3,871,529 A * 3/1975 Dial et al. ..... 213/21
4,252,068 A * 2/1981 Nolan ..... 105/420
4,848,611 A * 7/1989 Terlecky et al. ..... 213/64
5,704,296 A * 1/1998 Gagliardino et al. ..... 105/420
5,927,521 A * 7/1999 Downes et al. ..... 213/62 R
5,931,101 A * 8/1999 Kaufhold et al. ..... 105/420

* cited by examiner

*Primary Examiner*—S. Joseph Morano
*Assistant Examiner*—Frantz F. Jules
(74) *Attorney, Agent, or Firm*—Edward J. Brosius

(57) ABSTRACT

An extended end-sill assembly for a railcar, which assembly is produced by mating a front-sill casting and back-sill casting having a transition region therebetween wherein the endsill includes a cast-in-place center plate, a support arrangement for a cushioning apparatus and a wide-mouthed end for greater lateral travel of the coupler shank arm, and such dual casting assembly is inapposite to present production of such endsill assemblies that require fabrication of numerous plates, pieces and braces.

16 Claims, 10 Drawing Sheets

END SILL ASSEMBLY WITH CENTER PLATE CASTING

BACKGROUND OF THE INVENTION

The present invention provides an end sill assembly for a railroad car. More specifically, an extended length end sill assembly is provided for a railcar, with a truck assembly deeply recessed from a railcar end. Further, two as-cast components are mated to provide the end-sill assembly, which assembly is then connected to the railcar center sill. The longitudinal axes of the first and second as-cast components are vertically offset from each other to accommodate the height of the truck assembly and the alignment of the juxtaposed couplers of adjacent railcars.

Historically the elongated end-sill assemblies for automobile-carrying railcars have been fabricated components due to the extreme length of the end-sill arrangement. The fabrication process was both tedious and expensive. Casting the components of the as-cast end-sill assemblies provides two cast elements, which are ready for mating assembly and securement. This mating assembly eliminates the necessity for the fabrication and assembly of large plate sections to manufacture an elongate end-sill assembly, thus saving fabrication time and labor costs, as well as reducing the amount of space required for final assembly, storage of plate materials and the avoidance of multiple welds, which require care and inspection to avoid cold welds, porosity or other critical manufacturing defects. The casting parameters are more easily controlled on a more consistent basis, thus the component dimensions are more consistently repeated for ease of joining with mating parts.

The noted two-component system also moves the integrally cast center-plate and truck bolster into closer proximity to each other, which increases the available lading capacity of the railcar.

There are several extant cast draft sills and one is noted in U.S. Pat. No. 4,252,068 to Nolan. This structure is built with a generally planar base and planar top wall. It includes a tapered transition element at its inboard end for mating with the center sill. A pocket with a supporting rib structure is cast into the inboard end to receive a center filler plate. This disclosed end sill is expected to be between three and four feet in length, which is generally the length-dimension range of disclosed end sill structures for freight railcars in the U.S.

Alternatively, U.S. Pat. No. 5,809,899 to Kaufhold et al. discloses a cast draft sill with an integrally cast wheel truck connection. In one embodiment of this disclosure, a center pin extends downward from the draft-sill bottom for mating engagement with a standard center plate of a truck bolster.

A third cast draft-sill is shown in U.S. Pat. No. 5,931,101 to Kaufhold et al., which teaches a light weight draft sill with an integrally cast center-plate. However, in this disclosure and the above-noted patent structures the draft sills are single cast units with a single longitudinal axis generally provided between an upper plane and a lower plane. None of the structures are designed to accommodate an elongate end-sill assembly. Further, there is no disclosure or teaching of an angled end-sill assembly, either as a fabrication or casting.

SUMMARY OF THE INVENTION

The present invention provides a two-component cast end-sill assembly for mating with a center sill of a freight railcar. The first and front cast component or sill includes a housing for a cushioning device and the coupler shank. This first cast component has a longitudinal axis generally parallel to the longitudinal axis of the center sill. The back and second cast component of the end-sill assembly is mated to the center sill and has its longitudinal axis generally in alignment with the longitudinal axis of the railcar center sill. The elongated end-sill assembly is especially adaptable to automobile-carrier railcars where the lower longitudinal axis of the back sill permits added lading capacity while the front sill permits the coupler and cushioning devices to function in their normal modes of operation. The undercarriage truck assembly in these automobile carriers is displaced at an extended distance from the railcar ends, which requires use of the elongated end-sill assemblies and the long-shank couplers. The present assembly allows the use of the bell-mouth or wide-mouth front-sill to accept the long-shank coupler and permit adequate lateral motion of the coupler shank during railcar operation. In addition, the placement of the supporting rib structures allows expeditious mounting of the body bolster to the back sill, and the integral center plate assembly provides the mating center plate with a reduction in weight to the overall end-sill assembly, which weight reduction permits added railcar lading capacity.

BRIEF DESCRIPTION OF THE DRAWING

In the figures of the Drawing, like reference numerals identify like components, and in the Drawing.

DETAILED DESCRIPTION

Figure 9:
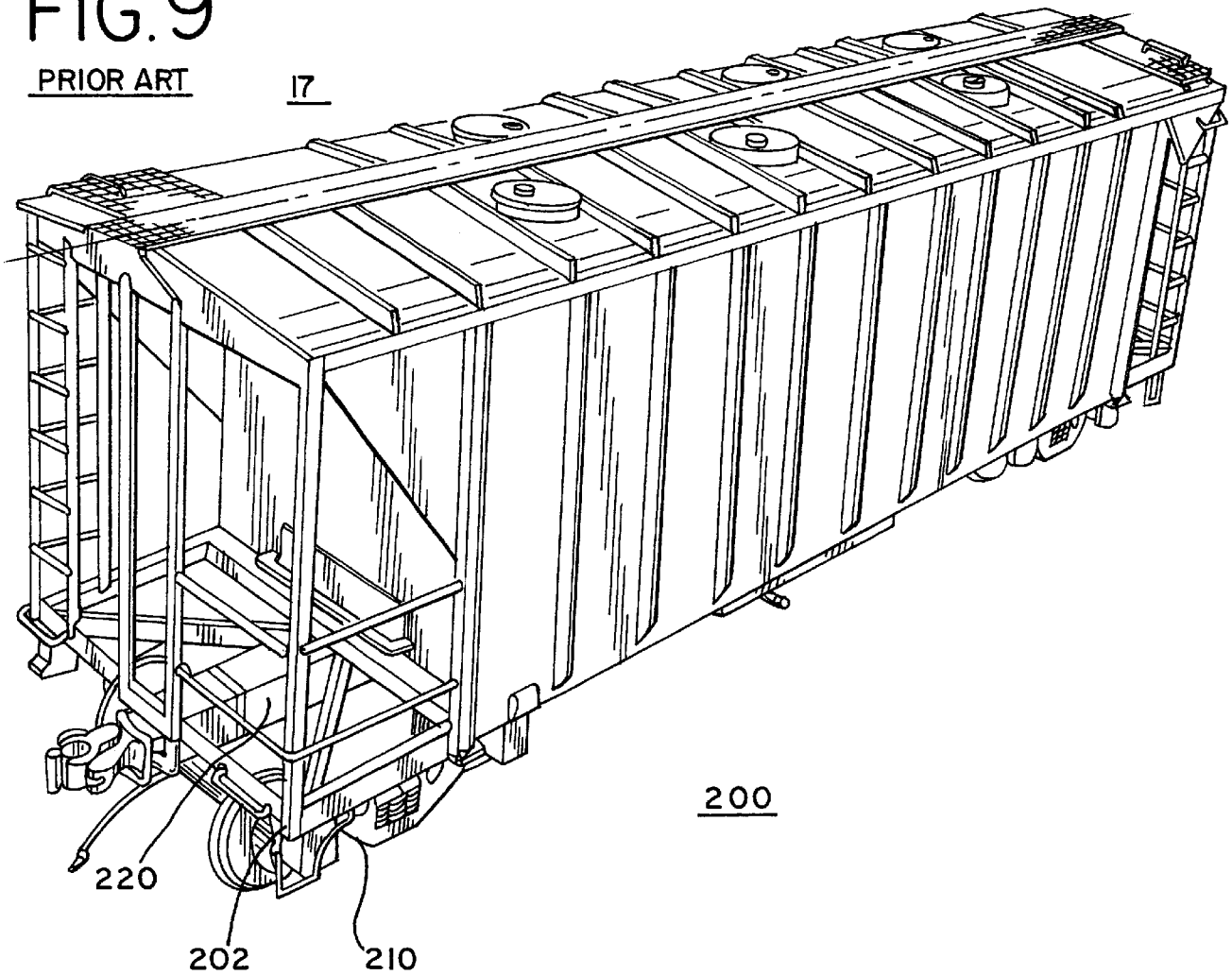
FIG. 9 PRIOR ART
FIG. 9 illustrates an exemplary freight railcar with an endsill and truck assembly.
Figure 10:
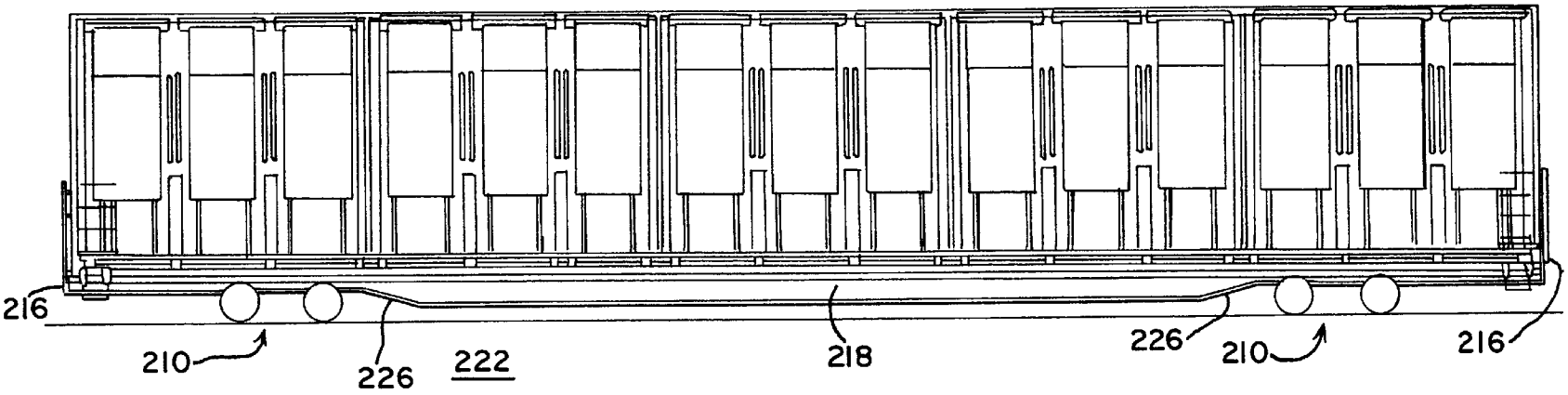
FIG. 10 is an exemplary illustration of an automobile carrier freight car with the railcar ends extending significantly beyond the truck assemblies at either car end.
Figure 11:
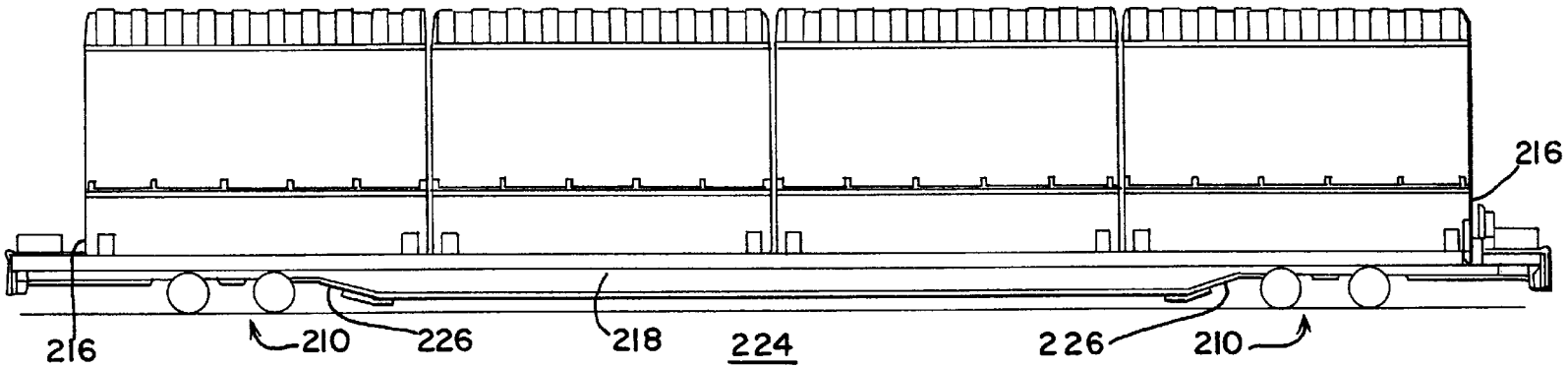
FIG. 11 is a second exemplary illustration of an automobile carrier freight car with the railcar ends extending significantly beyond the truck assemblies at either car end.

The present invention provides an elongated end-sill assembly 10 as noted in FIGS. 1 to 5, which assembly 10 finds particular application in freight railcars noted as auto carriers or standard flat cars (not shown). Exemplary auto-carrier railcars 222 and 224 are shown in FIGS. 10 and 11. In these auto-carrier railcars 222 and 224, the truck assembly is displaced at an extended distance from the car end in comparison to a typical gondola or boxcar type railcar 200, which is noted in FIG. 9. The term elongated refers to the length of end-sill assembly 10 in comparison to the typical end-sill assembly 220 for such gondola, boxcar or coal carrier railcar 200. As shown in FIG. 9, truck assembly 210 is in relatively close proximity to railcar end 202, thus avoiding the requirement for an elongated sill assembly 10. Exemplary automobile carriers 222 and 224 respectively illustrate a railcar to accommodate compact vehicles and a railcar intended to accommodate full-size vehicles as published in Car and Locomotive Cyclopedia (1974). In both FIGS. 10 and 11, truck assemblies 210 are significantly further displaced from the car ends 216 than is truck assembly 210 in FIG. 9.

Figure 8:
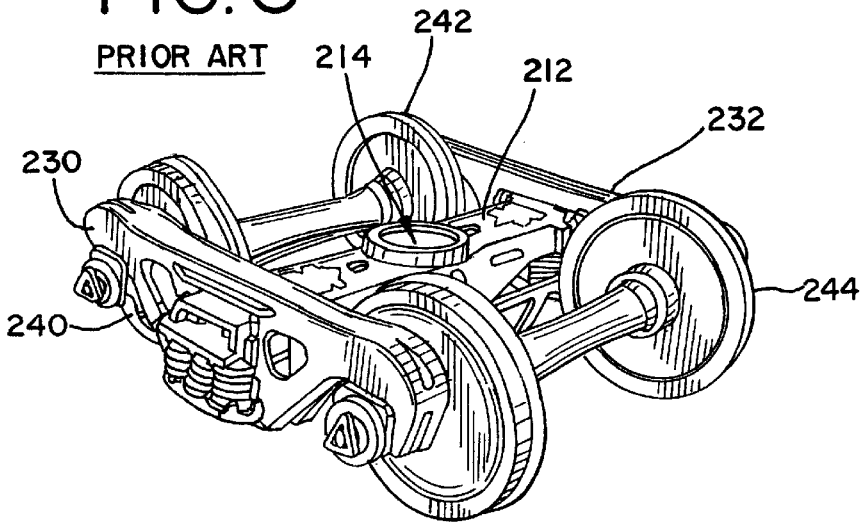
FIG. 8 PRIOR ART
FIG. 8 illustrates a prior art railcar truck assembly in an oblique view.

Truck assembly 210 in FIG. 8 is an oblique view of an illustrative railcar truck assembly. Truck assembly 210 has first and second sideframes 230 and 232, as well as four wheels 240, 242, 244 and 246 mounted at axle ends. In FIG. 8, bolster 212 has a bolster center plate 214 to receive a car body center plate for relative rotation between the mating center plates. The bolster plate center is approximately five feet from the car end in the typical freight car assembly of FIG. 9, which dimension is noted in the cited Car and Locomotive Cyclopedia (1974) at pages S3-85 and S3-86 for representative freight railcars. This arrangement of railcar 200 and truck assembly 210 is a typical assembly for the mounting of a railcar 200, and more specifically its center sill, onto a railcar truck assembly 210. However, the distance from the car end to the bolster center plate in autocarriers 222 and 224 of FIGS. 10 and 11 are almost twelve feet from the railcar end 216. Thus provision of an end sill assembly 10 for such elongated members has been accommodated by metal fabrication of plate materials meticulously assembled and welded in frames and jigs to produce an acceptable endsill assembly. However, such fabrication is labor intensive and time consuming to provide reproducible results and parts. Thus, it is desired to provide a cast product with a finished shape where possible as the molds for such castings can be readily reproduced and the machining or labor input after casting is considered to be nominal.

The present invention provides an elongated endsill assembly 10 for autocarrier railcars 222 and 224. More particularly, assembly 10 in FIGS. 4 and 5 has front sill 12 and back sill 14, which are mated and secured at junction 16. Securing of mated front sill 12 and back sill 14 can be accommodated by means known in the art such as welding, brazing, soldering or riveting for example. These are merely examples and not limitations. In the prior art illustrations of FIGS. 10 and 11, car body center sill 218 includes a sloped portion 226 for mating with endsills 220 inboard of truck assemblies 210. However, the present autocarrier railcars 222 and 224 have the tapered or sloped region 226 outboard or forward of truck assembly 210. This car structure change was noted to increase the lading capacity and must now be accommodated by the structure of endsill assembly 10 for both shape and load bearing capability.

Figure 5:
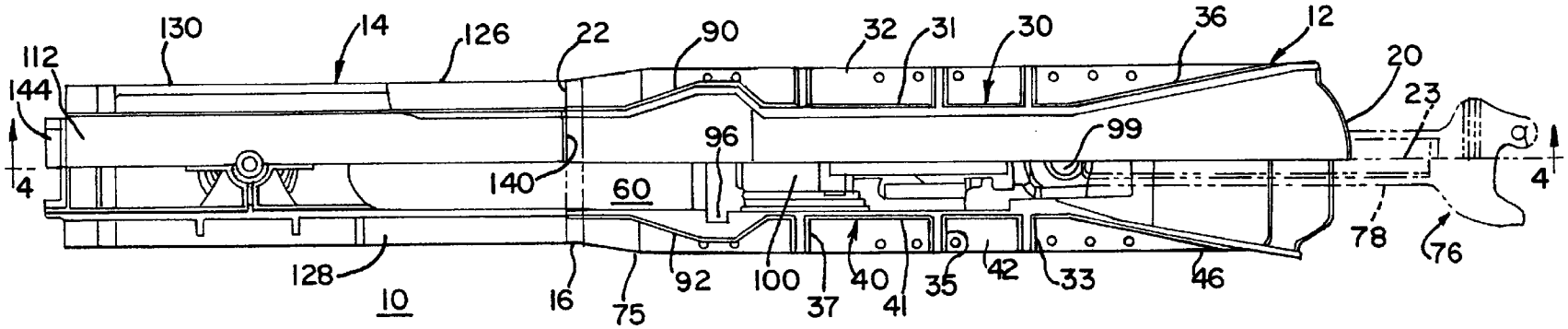
FIG. 5 is a plan view of the end-sill assembly of FIG. 4 in partial section.
Figure 4:
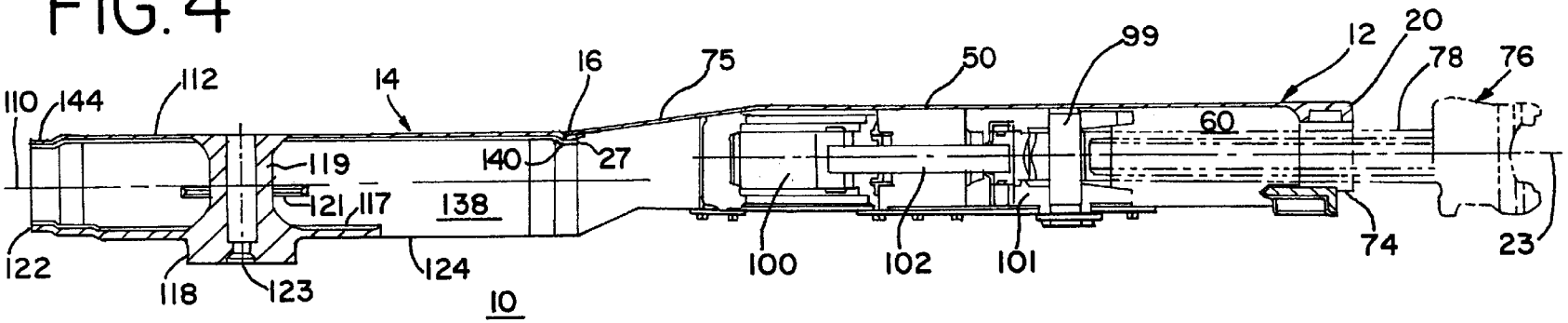
FIG. 4 is a longitudinal cross-section of the assembled end-sill assembly taken along line 4—4 in FIG. 5.
Figure 6:
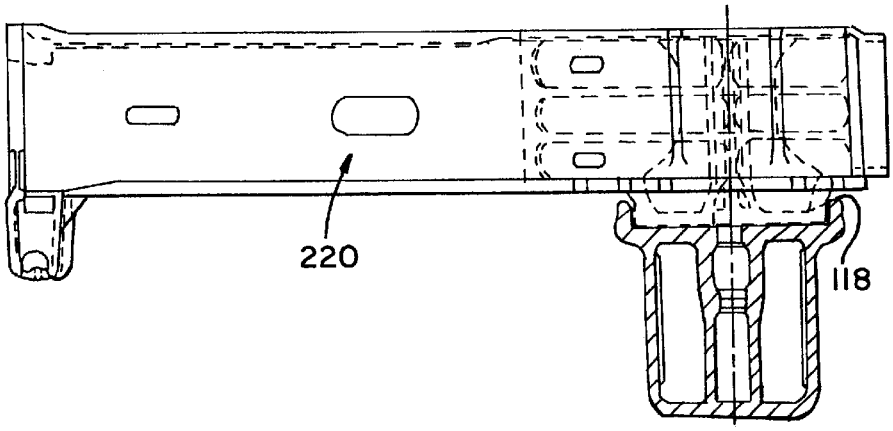
FIG. 6 PRIOR ART
FIG. 6 illustrates in cross-section a single-longitudinal-axis, prior art end-sill for a typical freight railcar.
Figure 7:
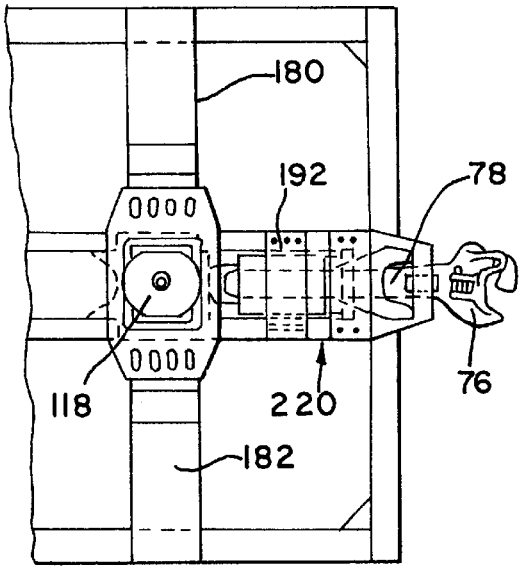
FIG. 7 PRIOR ART
FIG. 7 is a bottom view of a prior art end sill in position relative to the frame of a typical freight railcar.
Figure 12:
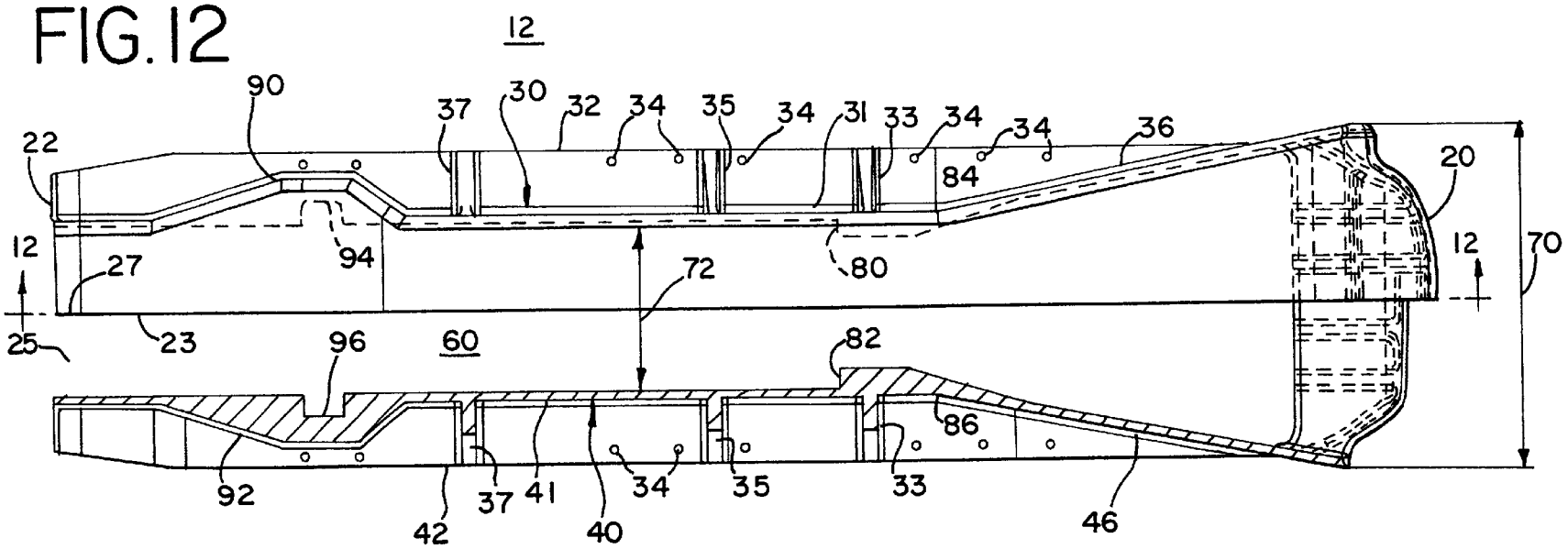
FIG. 12 is an enlarged plan view of the front-sill casting in partial section.

In FIGS. 4 and 5, front sill 12 of endsill assembly 10 has forward end 20, rearward end 22, and longitudinal axis 23. Front sill 12 is more clearly shown in FIGS. 12 and 12A in enlarged views. In these figures, front sill 12 has longitudinal axis 23, first sidewall 30, second sidewall 40, top wall 50 and cavity 60. Front sill 12 is approximately two-thirds of the net length of endsill assembly 10, which is only noted for consideration of proportion in this description and not as a limitation. First sidewall 30 has parallel segment 31, and laterally extending flange 32 with a plurality of apertures 34 along the length of front sill 12. Second sidewall 40 has parallel segment 41, and laterally extending flange 42 with a plurality of apertures 34 the length of front sill 12. First sidewall segment 31 and second sidewall segment 41 are generally parallel and are connected by top wall 50 with cavity 60 open at lower edge 62. Each of sidewalls 30 and 40 have multiple vertical reinforcing ribs 33, 35 and 37 along flanges 32 and 42, respectively, which ribs 33, 35 and 37 are sloped between sidewalls 30, 40 and flanges 32, 42. Alternatively, assembly 10 may be provided without ribs 33, 35 and 37 for mating with a railcar.

Forward end 20 is flared and has a first width 70, which is greater than second width 72 between first sidewall sement 31 and second sidewall segment 41. First sidewall 30 has first tapered segment 36 extending from forward end 20 to intersect parallell sidewall segment 31 at first intersection 84. Similarly, second sidewall 40 has second tapered segment 46 extending from forward end 20 to intersect second parallel segment 4l at second intersection 86. The tapered segments 36, 46 provide a bell or wide-mouth opening 74 at forward end 20 to accommodate a greater degree of lateral displacement to coupler 76 noted in FIGS. 4 and 5, which promotes greater safety for curves and less wear on the sidewalls 36, 46 from contact with coupler shank 78.

First front stop 80 and second front stop 82 in cavity 60 are integrally cast at respective first and second sidewall intersections 84 and 86. Front stops 80 and 82 are mechanical stops for the travel of cushioning unit 100 or, more specifically, its pocket casting 101 in FIGS. 4 and 5, which provides mechanical grounding for unit 100 in the draft direction of travel of railcars 222, 224.

In proximity to back end 22 in FIGS. 4, 5, 12, and 12A, first boss 90 is provided on first sidewall 30 and second boss 92 is provided on second sidewall 40. First boss 90 has slot 94 and second boss 92 has second slot 96, which slots 94, 96 are open to cavity 60 and in a facing alignment. Slots 94 and 96 are operable to receive a mounting bracket from a cushioning unit, such as unit 100 in FIGS. 4 and 5. Mounting slots 94, 96 provide a securing position for cushioning unit 100 and allow sliding engagement of its pocket casting for contact with front stops 80 and 82 during travel of the railcar in the draft direction. In addition, cushioning unit 100 is operable to absorb buff direction loads transferred through arm 102 in cavity 60 as unit 100 is secured in position in cavity 60 at slots 94 and 96. The specific type or style of cushioning unit 100 is not a limitation to the present invention, and the noted structure is merely exemplary.

In FIG. 4, coupler shank 78 is secured to pocket casting 101 of cushioning unit 100 by pin 99, which is a connection method known in the art. Further, it also known to connect a coupler and its shank to an endsill with a key, but the specific connecting means between cushioning unit 100, its pocket casting 101 and coupler shank 78 is not a limitation to the present invention.

Figure 12A:
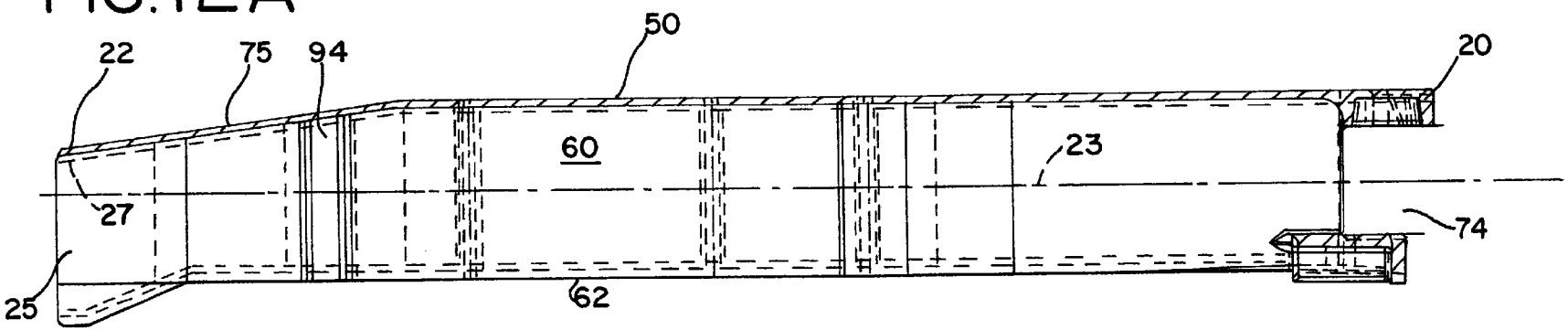
FIG. 12A is a cross-sectional view of the front-sill casting in FIG. 12 taken along the line 12—12.

As noted in FIGS. 4 and 12A, front sill 12 has transition region 75 with upper wall 50, sidewalls 30 and 40, and flanges 32 and 42 downwardly tapered generally between first and second bosses 90 and 92. The specific angle of the taper or slope of these structural walls is adequate to accommodate the necessity to provide rear opening 25 in alignment to receive back sill 14. More particularly, it is noted in FIGS. 4 and 12A that top wall 50 initiates its taper forward of first and second bosses 90 and 92, but flanges 32 and 42 only taper from the back of bosses 90 and 92, which is the design necessity for coping with the difference in height of sidewalls 30 and 40. Sidewalls 30 and 40 are similarly tapered to meet back opening 25. In addition, back opening 25 has a narrow internal land or perimeter 27, which is generally parallel to longitudinal axis 23 to accommodate mating with back sill 14. Although transition region 75 is noted as integral with back end 22 of front sill 12, it is considered that transition region 75 could be cast at forward end 120 of back sill 14 to mate with front sill 12. A further, alternative structure could, if required, provide transition region 75 as an independent cast structure for mating with forward end 120 and back end 22 of cast back sill 14 and front sill 12, respectively.

Back sill 14 in FIGS. 4, 5, 13 and 13A is generally a straight casting with longitudinal axis 110, forward end 120, rearward end 122, upper wall 112, lower edge 124, first sidewall 114, second sidewall 116 and a cast-in-place center plate 118 for mating with a bolster center plate, such as bolster center plate 214 in FIG. 8. Back-sill longitudinal axis 110 is vertically displaced downward from front-sill longitudinal axis 23, which change in vertical position is accommodated by tapered transition region 75 of front sill 12 to thus provide assembly 10 after mating of back-sill 14 and front-sill 12.

Figure 13:
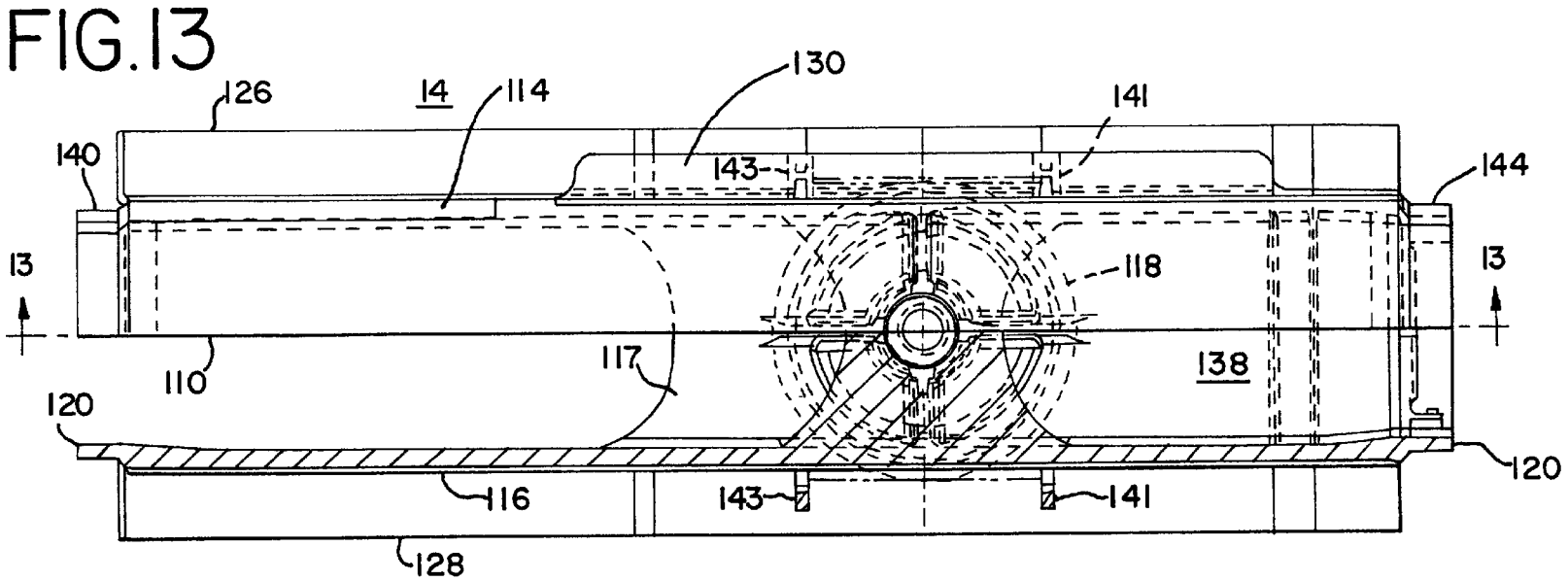
FIG. 13 is an enlarged plan view of the back-sill casting in partial section; and, FIG. 13A is a cross-sectional view of the back-sill casting in FIG. 13 taken along the line 13—13.
Figure 13A:
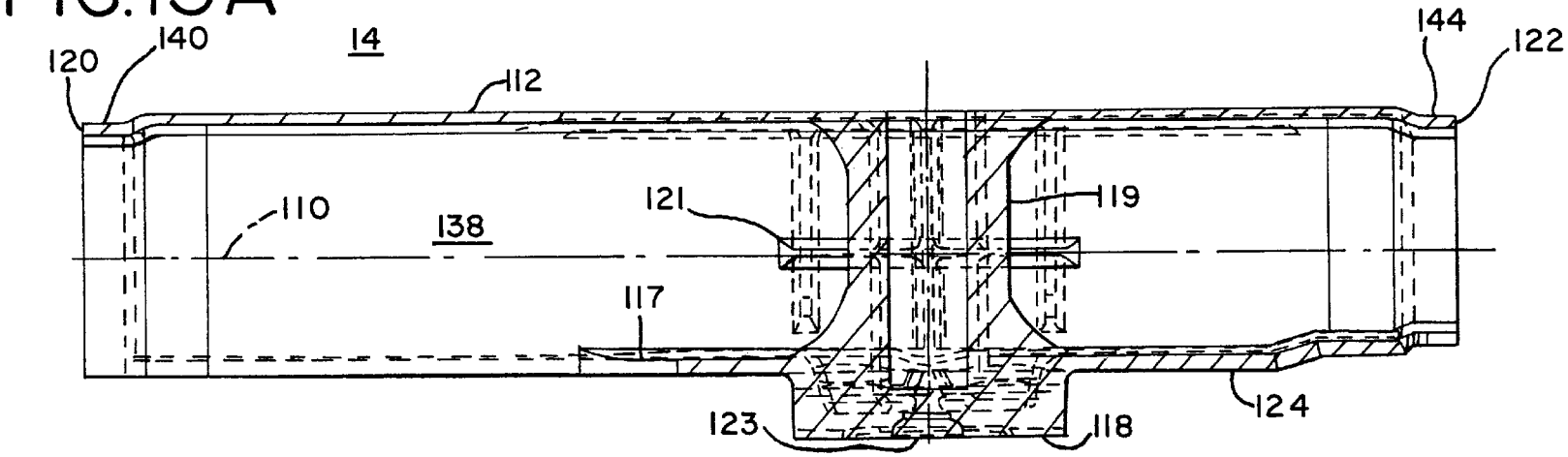

First back-sill sidewall 114 in FIGS. 5 and 13 has a lower flange 126 along the length of back-sill lower edge 124. Similarly, second back-sill sidewall 116 has lower flange 128 extending the length of back sill 14 at lower edge 124. In addition, first and second sidewall 114 and 116 each have respective upper flanges, however, only upper flange 130 along sidewall 114 at upper wall 112 is shown, but a similar upper flange is provided along sidewall 116 at upper wall 112. Upper flanges 130 extend about an equidistant longitudinal length along sidewalls 114, 116 on either side of center plate 118. Back sill 14 has chamber 138, which is generally open at lower edge 124, but center plate 118 partially occupies at least a portion of the volume of chamber 138 and thus partially encloses chamber 138. Vertical outer reinforcing ribs 141 and 143 are provided on each sidewall 114 and 116, which ribs 141,143 are utilized to locate or position the body bolsters coupled to back-sill 14 at assembly to a railcar.

Center plate 118 is illustrated as an annulus protruding below lower edge 124. However, center plate 118 has vertical support ribs 119 extending between lower edge 124 and upper wall 112 in chamber 138. In addition, horizontal support rib or disc 121 extends between first sidewall 114 and second sidewall 116 approximately midway the distance between lower edge 124 and upper wall 112 in chamber 138. Aperture 123 extends through bolster center plate 118, and appears in plan view as a continuous bore or passage extending through upper wall 112. In addition, center plate 118 has bottom plate 117 at lower edge 124 extending between first and second sidewalls 114 and 116.

Figure 1:
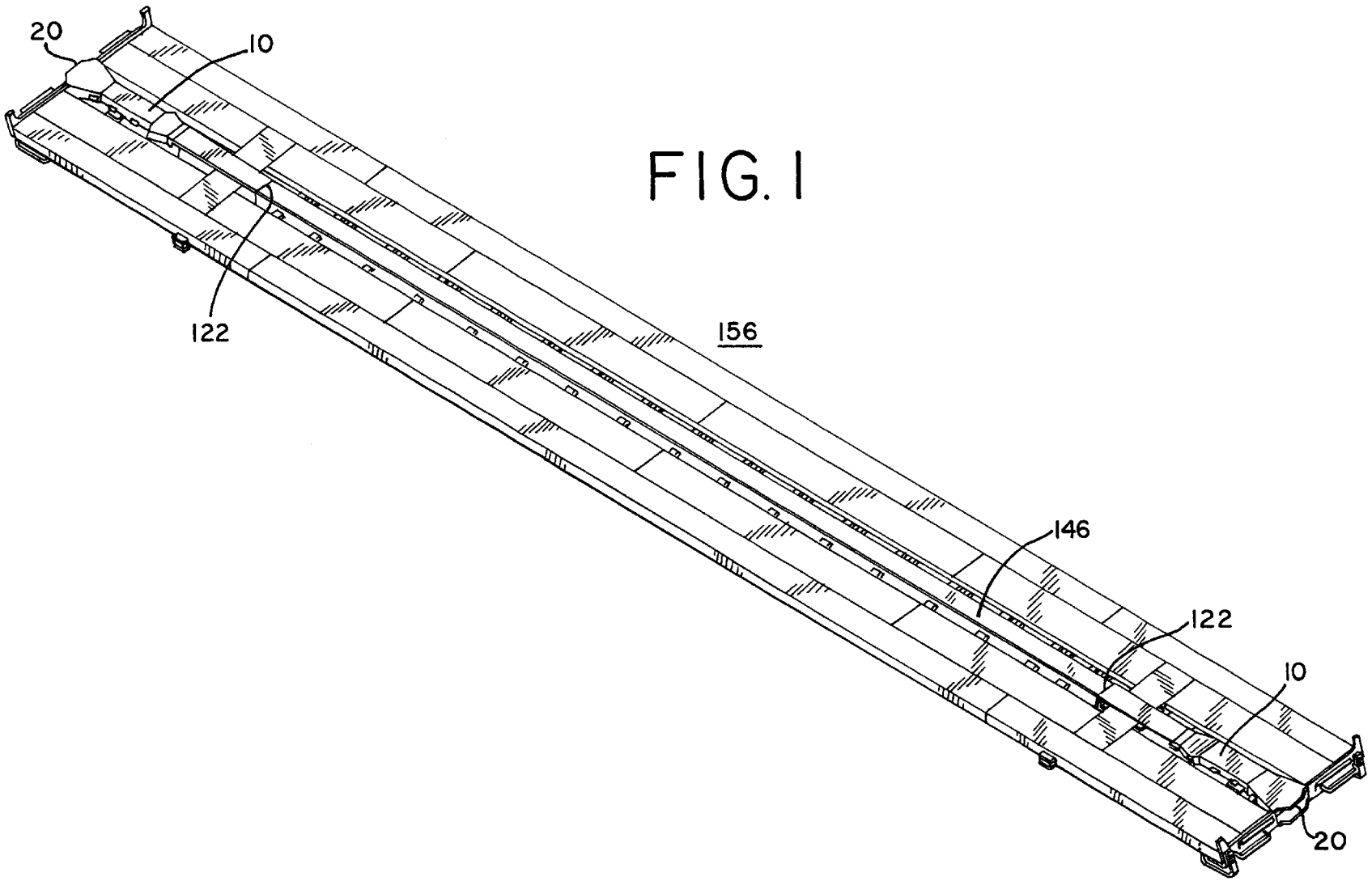
FIG. 1 is an oblique top view of the deck, center sill and end-sill assembly of a vehicle carrier railcar.
Figure 1A:
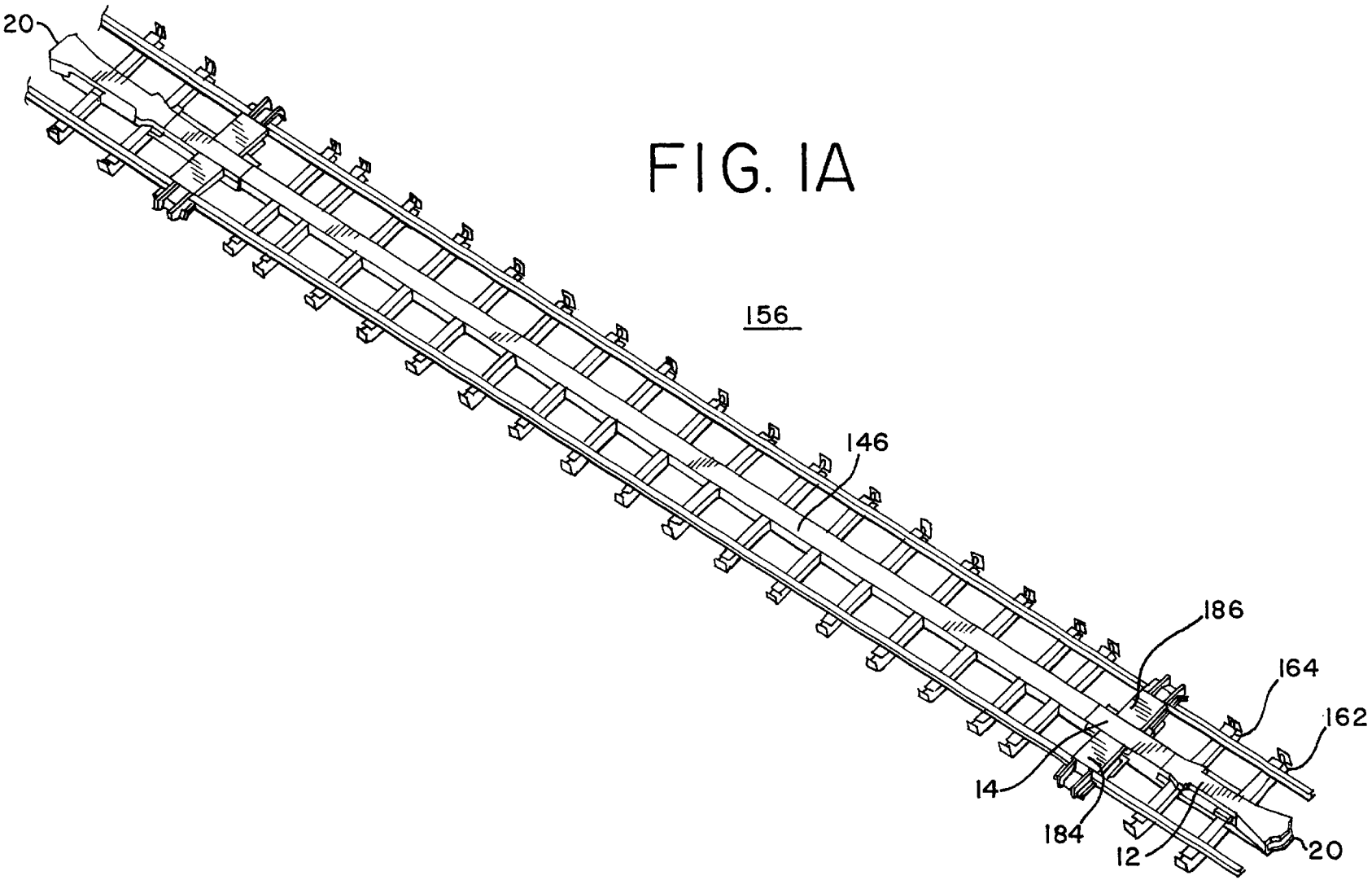
FIG. 1A is the railcar structure of FIG. 1 noting only the center sill, the end-sill assemblies and the deck support cross-beams extending from the center-sill.

Forward end 120 of back sill 14 has a flared or compressed structure terminating in a flat land 140, which is noted as extending about the perimeter of back sill 14, which flared structure appears to telescope from back sill 14 for mating with land perimeter 27 of front-sill back-end 22 at opening 25. Rearward end 122 of back sill 14 also has a flared portion with telescoping land perimeter 144 for mating with the railcar body center sill 146, which is noted in FIGS. 1 and 1A.

At mating of back-sill land 140 with front-sill land perimeter 27 the two cast elements, back sill 14 and front sill 12, are joined to provide a single end sill casting 10. The mated components provide a complex structure, elongate end sill 10, from two castings front sill 12 and back sill 14 with nominal secondary operations. Securing of the two castings may be accommodated by means known in the art, such as welding.

Figure 2:
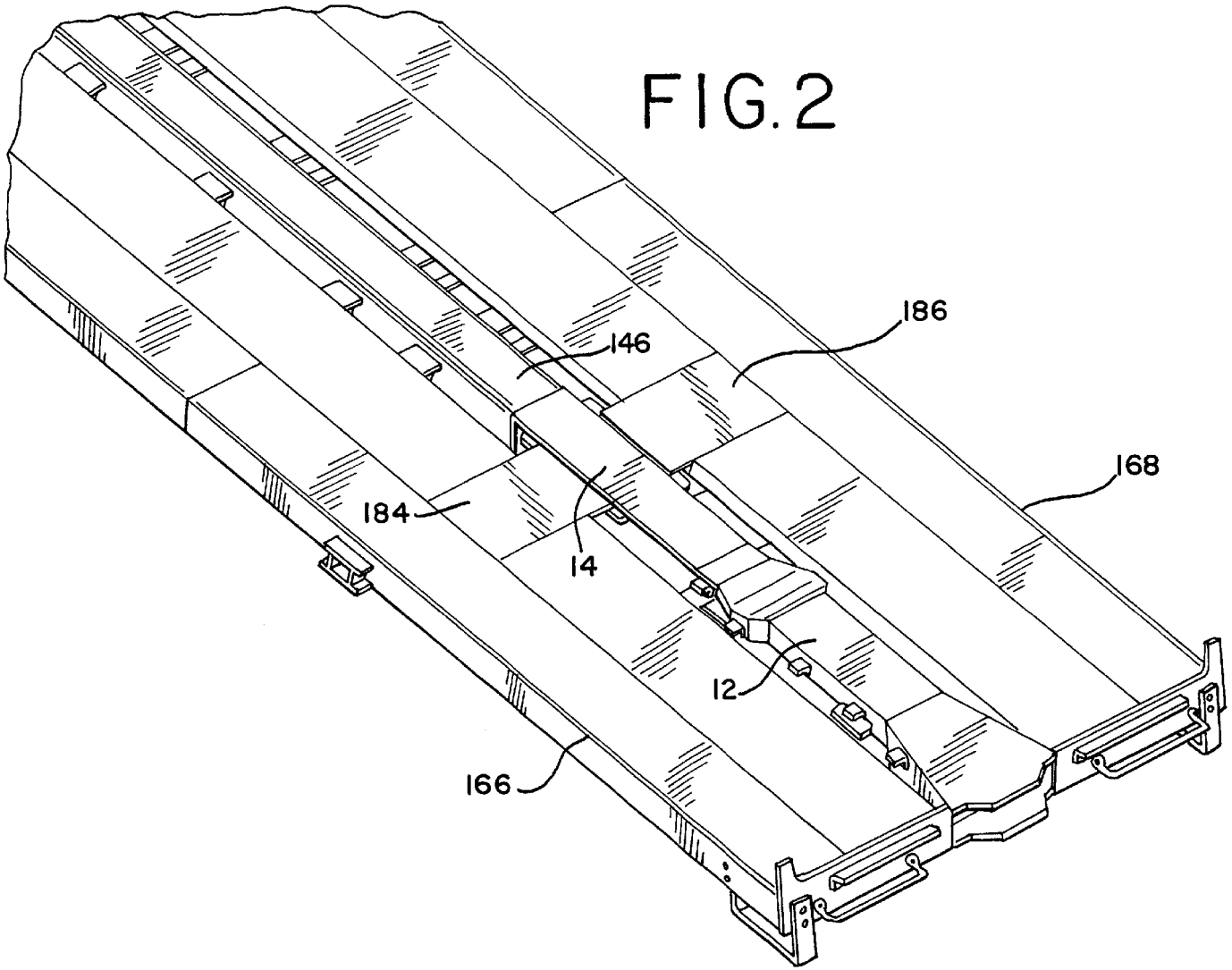
FIG. 2 is an enlarged view of one end of the railcar structure of FIG. 1.
Figure 3:
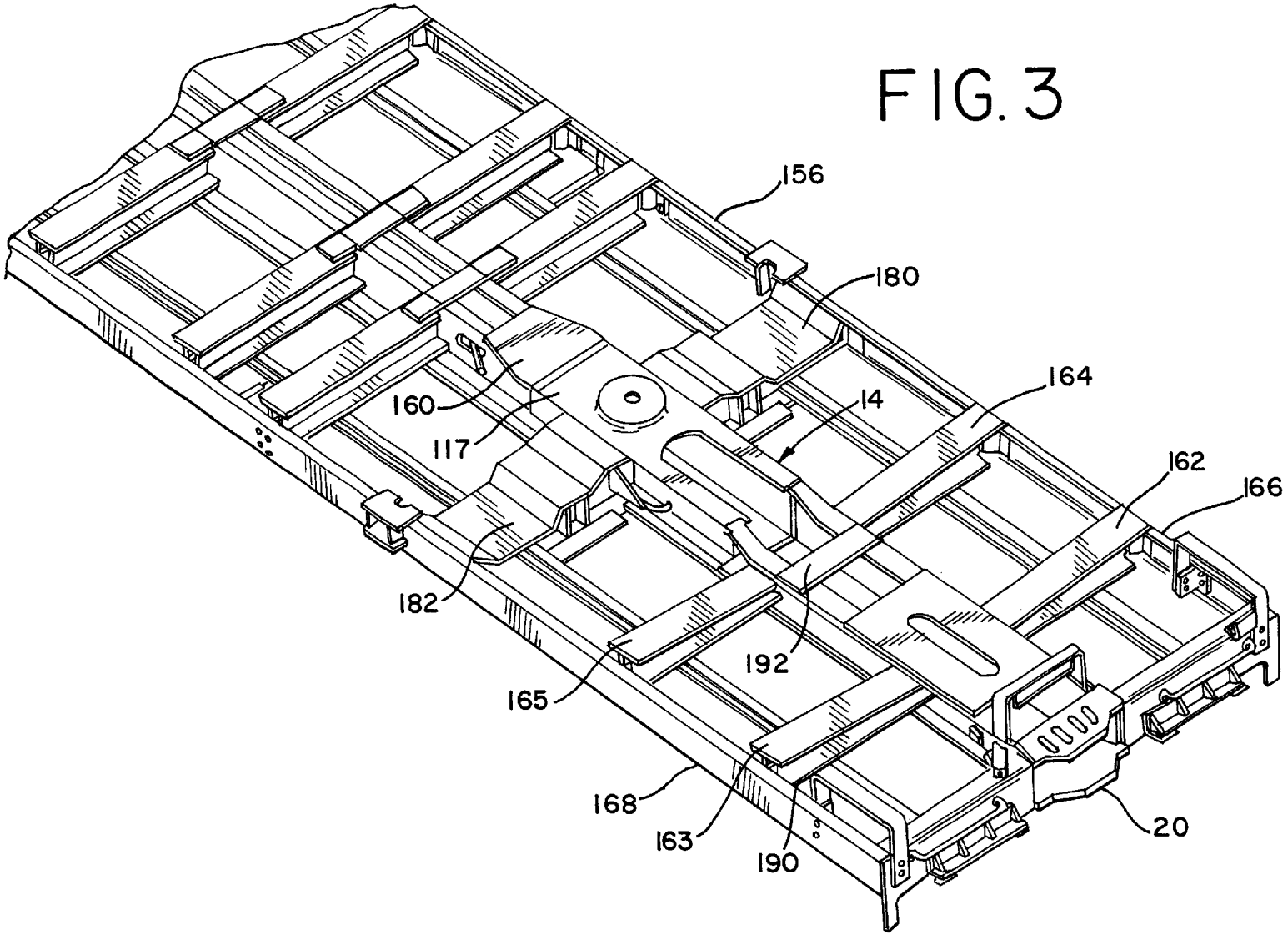
FIG. 3 is a bottom view of the railcar structure of FIG. 2.

Front sill 12 and back sill 14 are mated to provide endsill assembly 10, which assembly 10 is mated with center sill 146 by the nesting of rear land 144 into center sill 146. The junction of the connected center sill 146 and endsill assembly 10 junction may be secured by means such as weldments and a tie plate 160 noted in FIG. 3. Further, crossbearers 162 and 164 of railcar 156 are noted in FIGS. 1A and 3 on either side of endsill assembly 10. Crossbearer 162 extends from railcar side 166 and is secured to front-sill second sidewall 40 between reinforcing ribs 33 and 35. Similar crossbearer 163 is provided to be secured between first sidewall 30 and railcar side 168, and it is similarly secured between reinforcing ribs 33 and 35 on first sidewall 30 in the case where ribs 33 and 35 are present. Second crossbearer 164 extends from railcar side 166 to be coupled to second sidewall 40 generally in proximity to boss 92 and reinforcing rib 37. Again a similar crossbearer 165 is provided from railcar side 168 for connection to endsill assembly 10 and first sidewall 30 in proximity to boss 90 and reinforcing rib 37. It is understood that the crossbearers coupled to similar positions on first and second sidewalls 30 and 40 are generally aligned between the railcar sides 166 and 168. First body bolster 180 extends from railcar side 166 and is secured to back-sill second sidewall 116 between ribs 141 and 143. Second body bolster 182 extends from railcar side 168 and is secured to back-sill first sidewall 114 between ribs 141 and 143. Body bolsters 180 and 182 are generally aligned and may be secured by means known in the art, such as welding. In FIG. 2, first cover plate 184 is secured onto first body bolster 180 and second-sidewall upper flange 130 generally in planar alignment with upper wall 112. Similarly second cover plate 186 is secured onto second body bolster 182 and first-sidewall upper flange 130 generally in planar alignment with upper wall 112 and first cover plate 184.

Front support plate 190 and rear support plate 192 for cushion unit 100 are secured to front-sill flanges 32 and 42 to secure cushion unit 100 in chamber 60. Support plates 190 and 192 are secured to flanges 32 and 42 by means known in the art such as welding, brazing, riveting or other means.

As noted above, front-sill 12 and back-sill 14 are individually cast components, which do not require elaborate machining, individual jigs or fixtures. In endsill assembly 10, longitudinal axis 110 of back-sill casting 14 is vertically lower than longitudinal axis 23 of front-sill casting 12, although both axes are generally parallel to each other and the longitudinal axis of railcar 156. Endsill assembly 10 is designed with these offset axes 23 and 110 to accommodate a railcar structure which allows more lading than previous railcar structures. The offset axes are accommodated by transition region 75 between back end 22 and bosses 90 and 92 of front-sill 12. In this arrangement, front-sill casting provides the housing for installation and operation of cushioning unit 100 and coupler shank 78 at the correct vertical elevation for interchange service. Simultaneously, back sill casting 14 accommodates the lower level deck along railcar center sill 146, and includes an integral body bolster center plate for mating with a truck assembly center plate, for example truck bolster center plate 214 in FIG. 8. These two castings 12 and 14 require the usual post-casting operations to remove extraneous material such as sprues, risers and flashing, but they do not require precise alignment of individual sidewalls 30, 40, 114 and 116 as well as upper walls 50 and 112 in jigs and fixtures before welding long seams at contacting corners. Thus the threat of cold weld joints, weld porosity, heat affected zones, as well as other hazards coupled with such fabrication are avoided. As a result of avoiding the problems and costs associated with fabrication of individual panels to produce an endsill assembly, some of the benefits realized by casting and mating of only two components are labor savings, consistently reproduced castings for the final assemblies, and a reduction in the number and cost of jigs and fixtures.

In operation, endsill assembly 10 provides a housing for cushioning unit 100 and allows mating of coupler shank 78 with the pocket casting of unit 100 by pin 99, as shown in FIGS. 4 and 5. The wide-mouthed end 20 of front-sill casting 12 and endsill assembly 10 allows significant lateral displacement of coupler shank 78, which improves the operation of truck assembly 210 and railcar 156 through curves without potentially damaging impact of shank 78 against sidewalls 30 and 40.

While only specific embodiments of the invention have been described and shown, it is apparent that various alterations and modifications can be made therein. It is, therefore, the intention in the appended claims to cover all such modifications and alterations as may fall within the scope and spirit of the invention.

What is claimed is:

1. A cast, sill-end assembly for a railcar, said railcar having a longitudinal axis, a coupler with a knuckle and a shank, a center sill with a first end and a second end, a body bolster, and at least one railcar truck assembly, said sill-end assembly comprising:

a cast front sill, a cast back sill and a transition region between said front sill and said back sill;

said cast front sill and cast back sill in contact through said transition region and aligned along said railcar longitudinal axis, and securing means connecting said cast front sill and said cast back sill to provide said sill-end assembly, said cast front sill having a second longitudinal axis, a forward end, a rearward end, a top wall, a first side wall, and a second side wall, said first and second side walls and said top wall cooperating to define an enclosure, said enclosure open at said forward end and said rearward end;

supporting means mounted in said enclosure;

said cast back sill having a third longitudinal axis, a center plate, an upper wall, a third side wall, a fourth side wall, a lower edge, a front end and a back end, said upper wall, third side wall and fourth side wall cooperating to define a chamber, a center plate mounted at said lower edge;

said cast back-sill front end matable with said cast front-sill rearward end, and said cast back-sill back end matable with one of said center-sill first and second ends;

said cast front-sill having a transition region, said front-sill top wall, first side wall and second side wall rearward of said supporting means being downwardly sloped from said second longitudinal axis to said rearward end to provide said transition region;

said cast back-sill having a third longitudinal axis, said second and third longitudinal axes approximately parallel to said railcar longitudinal axis, said second longitudinal axis vertically displaced above said third longitudinal axis;

said cast front-sill rearward end opening operable to receive said back-sill front end, said mated back-sill and front-sill joined by said securing means to provide said cast sill-end assembly for mating with said center-sill.

2. A cast, sill-end assembly for a railcar as claimed in claim 1 wherein said front sill forward end and rearward end are open to said enclosure, said first sidewall having a first segment and said second sidewall having a second segment, said first and second segments parallel to each other and said second longitudinal axis, said first and second segments cooperating to define a first width between said segments, said forward end having a first edge and a second edge and a second width defined between said first and second forward-end edges, said second width greater than said first width, each said first and second walls having a tapered wall section extending from said first and second forward-end edges to said first and second parallel wall segments, said tapered wall segments and top wall cooperate to define a wide-mouthed end for a coupler shank.

3. A cast, sill-end assembly for a railcar as claimed in claim 2, said assembly further comprising a cushioning unit and means for securing, said unit mounted in said front-sill enclosure in said supporting means, said securing means anchoring said cushioning unit in position in said enclosure.

4. A cast, sill-end assembly for a railcar as claimed in claim 3 wherein said supporting means has a first boss along said first sidewall and a second boss along said second sidewall, each said first and second boss having a slot open to said enclosure; said cushioning unit having means for mounting; said slots in facing alignment and operable to receive said unit mounting means to secure said cushioning unit in said enclosure.

5. A cast, sill-end assembly for a railcar as claimed in claim 4 further comprising a coupler assembly having a coupler shank with a first end, a second end and a coupler at one of said first and second ends;

said cushioning unit having means for connecting said unit with said other shank end and, means for attaching said shank end and said connecting means for operation between said coupler assembly and said cushioning unit.

6. A cast, sill-end assembly for a railcar as claimed in claim 5 and further comprising at least one cushion support plate, said at least one plate mounted under said front-sill enclosure and secured to said flanges by said securing means to maintain said cushioning unit in said enclosure.

7. A cast, sill-end assembly for a railcar as claimed in claim 3 further comprising a plurality of reinforcing ribs;

each said front-sill first and second sidewall having an outer surface, a lower edge and a outwardly protruding flange at said lower edge longitudinally extending along said outer surface;

at least two of said reinforcing ribs provided on each said first and second sidewall outer surface and contacting said flanges;

said ribs on said opposing wall surfaces in approximate lateral alignment.

8. A cast, sill-end assembly for a railcar as claimed in claim 7 wherein said center plate in said back sill is cast-in-place, said center plate having a platen at said lower edge, said platen cast between said third sidewall and fourth sidewall, said center plate having a plurality of vertical support ribs, said vertical ribs in said chamber extending between said cast platen and said upper wall, said center plate having at least one horizontal rib in said chamber extending between said third and fourth sidewalls between said platen and said upper wall, said vertical and horizontal ribs reinforcing said center plate and said platen.

9. A cast, sill-end assembly for a railcar as claimed in claim 7 wherein said railcar has a first side, a second side, a front end and a rearward end, a plurality of crossbearer members, at least one of said crossbearer members extending from one of said first and second railcar sides to contact one of said front sill, first and second sidewalls between said reinforcing ribs, at least another of said crossbearer members extending from the other of said first and second railcar sides to contact the other of said front-sill first and second sidewalls between said reinforcing ribs, said securing means connecting said crossbearer members to said first and second sidewalls.

10. A cast, sill-end assembly for a railcar as claimed in claim 1 wherein said front-sill first sidewall, second sidewall and said top wall at said rearward end has a perimeter with a land, said land being expanded to provide an aperture for receipt of said back-sill front end.

11. A cast, sill-end assembly for a railcar as claimed in claim 10 wherein said back-sill third sidewall, fourth sidewall and upper wall at said front end have a contracted perimeter for mating with said front-sill, rearward end land for assembly and connecting by said securing means.

12. A cast, sill-end assembly for a railcar as claimed in claim 10 wherein said back-sill third sidewall, fourth sidewall and upper wall at said back end have a second contracted perimeter;

said railcar having a center sill with a first end and a second end, each said center-sill first and second end having an opening for mating with a sill-end assembly back end second contracted perimeter, said back sill back end mated with one of said center-sill first and second ends to provide an end sill arrangement for said railcar.

13. A cast, sill-end assembly for a railcar as claimed in claim 12 wherein said railcar has a first body bolster and a second body bolster, one of said first and second body bolsters extending from one of said first and second railcar sides to contact one of said back-sill third and fourth sidewalls in proximity to said center plate, the other of said first and second body bolsters extending from the other of said first and second railcar sides to contact the other of said third and fourth sidewalls in proximity to said center plate, said securing means connecting said first and second body bolsters to said third and fourth sidewalls, said first and second body bolsters approximately in alignment between said first and second railcar sides.

14. A cast, sill-end assembly for a railcar as claimed in claim 13 and further comprising at least one body bolster cover plate, one of said body-bolster cover plates positioned over said first body bolster and another of said body-bolster cover plates positioned over said second body bolster;

said back sill having a first upper flange and a second upper flange, one of said first and second upper flanges mounted along said upper wall and extending from one of said third and fourth sidewalls at said bolster plate, the other of said upper flanges mounted along said upper wall and extending from the other of said third and fourth walls at said bolster plate, Said body-bolster cover plates connected to said railcar sides and respective upper flanges over said body bolster by said securing means.

15. A cast, sill-end assembly for a railcar, said railcar having a longitudinal axis, a coupler with a knuckle and a shank, a center sill with a first end and a second end, a body bolster, and at least one railcar truck assembly, said sill-end assembly comprising:

a cast front sill, a cast back sill and a transition region between said front sill and said back sill;

said front sill and back sill in contact through said transition region and aligned along said railcar longitudinal axis, and securing means connecting said cast front sill and said cast back sill to provide said sill-end assembly, said cast front sill having a second longitudinal axis, a forward end, a rearward end, a top wall a first side wall, and a second side wall, said first and second side walls and said top wall cooperating to define an enclosure, said enclosure open at said forward end and rearward end;

means for supporting, said supporting means mounted in said enclosure;

said cast back sill having a third longitudinal axis, a center plate, an upper wall, a third side wall, a fourth side wall, a lower edge, a front end and a back end, said upper wall, third side wall and fourth side wall cooperating to define a chamber, a center plate mounted at said lower edge;

said cast back-sill front end matable with said front-sill rearward end, and said cast back-sill back end matable with one of said center-sill first and second ends;

said cast back-sill having a transition region, said back-sill upper wall, first side wall and second side wall forward of said center plate upwardly sloped from said third longitudinal axis to said forward end to provide said transition region;

said second and third longitudinal axes approximately parallel to said railcar longitudinal axis, said second longitudinal axis vertically displaced above said third longitudinal axis;

said front-sill rearward end opening operable to receive said back-sill front end, said mated back-sill and front-sill joined by said securing means to provide said cast sill-end assembly for mating with said center-sill.

16. A cast, sill-end assembly for a railcar as claimed in claim 15 wherein said railcar has a first side, a second side, a front end and a rearward end, a plurality of crossbearer members, at least one of said crossbearer members extending from one of said first and second railcar sides to contact one of said front sill, first and second sidewalls, at least another of said crossbearer members extending from the other of said first and second railcar sides to contact the other of said front-sill first and second sidewalls, said securing means connecting said crossbearer members to said first and second sidewalls.

* * * * *